United States Patent [19]

Harris

[11] 4,179,107

[45] Dec. 18, 1979

[54] PRINTING AND COLLATING METHOD

[75] Inventor: Jerome R. Harris, Charlottesville, Va.

[73] Assignee: Amprint Corp., Gordonsville, Va.

[21] Appl. No.: 789,339

[22] Filed: Apr. 20, 1977

Related U.S. Application Data

[63] Continuation of Ser. No. 623,748, Oct. 20, 1975, abandoned.

[51] Int. Cl.[2] ..... B41F 13/58

[52] U.S. Cl. ..... 270/4; 270/18; 270/32; 270/37; 270/52

[58] Field of Search ..... 270/4–19, 270/32, 52, 53, 37, 41–44; 101/219–228

[56] References Cited

U.S. PATENT DOCUMENTS

| | | | |
|---|---|---|---|
| 1,139,154 | 5/1915 | Bechman | 270/5 |
| 2,577,568 | 12/1951 | Florez | 270/4 X |
| 3,220,347 | 11/1965 | Luehrs | 101/220 X |
| 3,237,934 | 3/1966 | Rosenberg | 270/53 |
| 3,966,185 | 6/1976 | McCain | 270/54 |

*Primary Examiner*—Edgar S. Burr
*Assistant Examiner*—A. Heinz
*Attorney, Agent, or Firm*—Amster, Rothstein & Engelberg

[57] ABSTRACT

This invention relates to a method of printing, collating and binding booklets, magazines, pamphlets and similar printed material in one, two or four colors utilizing a novel procedure for assuring precise printing and collating registration. In the printing operation, the present method provides great flexibility whereas the same printing equipment can be used for two-sided printing with full four-color printing on each side and variations thereof. In the collating operation, the present method provides for precise collation of multiple printed pages. In particular, the printing and collating operation utilizes a series of punched holes for orienting the pages during processing which punched holes are removed in a final trimming operation, allowing on-line printing, collation and binding at high production rates and with decreased waste.

11 Claims, 11 Drawing Figures

PRINTING AND COLLATING METHOD

This is a continuation of application Ser. No. 623,748, now abandoned, filed Oct. 20, 1975.

The present invention relates generally to the printing, collating and binding of diverse printed materials including magazines, booklets and the like and in particular to a highly flexible and versatile printing and collating process by which both short and long run printing may be readily and efficiently accomplished in either one, two or four colors, lending itself to substantial in-line automation and corresponding production efficiencies.

The art of multiple color printing is highly developed. Typically, in the so called multi-color web offset press a relatively wide web of paper is fed past print towers wherein a large number of different pages are printed simultaneously and in side-by-side relation on one or both sides of such web. After the initial printing of the web, which could include as many as six side-by-side web sections each printed on its opposite faces, the web is slit into a plurality of side-by-side web sections or ribbons. Next, the side-by-side web sections are placed in a superposed stack and the stack is cut into segments roughly the size of two consecutive pages printed, and folded in collated form into what is known in the trade as a "signature". A plurality of such signatures are then accumulated by the signature forming apparatus and transferred to a binding area which requires separate loading and unloading operations. Such collated signatures are then bound into the final printed product.

Usually in such multi-color web offset presses, the printing and collation is achieved in the same equipment. For example, after the wide web is split into the side-by-side parallel ribbons or web sections, such parallel ribbons or webs are passed over turning rollers to move the same out of the path of travel through the press whereby the successive cut ribbons and web sections emerge at approximately right angles to their original direction of travel; and by appropriate arrangement of the turning rollers, the ribbons and web sections are superposed one above the other for the subsequent cutting and folding operations.

There are many disadvantages in such conventional multi-color web offset presses and folders which result in increased production costs, such as inordinately long set-up procedures and corresponding waste of paper and ink, breakdowns in one section or another which require shut down of both the printing and collating operation, web breakage and the like. For example, since the standard multi-colored press uses a relatively wide web of paper there is a corresponding substantial paper waste in setting up the press to run in registration and with the proper color values. Typically, several set-up runs are required at normal operating speeds and for reasonably substantial durations to assure that all of the printing stations are functioning in proper registration to each other in producing the desired color values both individually and collectively. The wider the web the more time is required to adjust feed rates of ink across the web. Further, inherent with the use of a relatively wide web in a printing press there is necessarily more inertia to overcome when starting and stopping the press. Therefore, there is a greater likelihood of corresponding web breakage during both set-up and printing.

Still further with such prior art equipment it is customary to print both the front and back of the web simultaneously with a corresponding wetting and weakening of the web, thereby contributing to the likelihood of web breakage and corresponding lost machine time. Still further, with an integrated press and folder set-up and running problems in either the press or collator contribute to overall downtime for the machine. For example, if there is a need for adjustment or servicing of the press, obviously the folder is not in operation; and conversely, folder repair or maintenance involves downtime for the press.

Further, in this typical printing equipment and process, the separate operations incident to making the signatures and their ultimate binding into the final product necessarily involves additional machine operations, corresponding manual handling and production losses. For example, as a result of damage to completed but unbound signatures, it is not uncommon for a printer to include an over-run based upon previous production experience to take into account shrinkage as a result of the separate handling of signatures in accordance with the conventional printing technique.

It is broadly an object of the present invention to provide an improved process for printing and collating which overcomes one or more of the foregoing disadvantages which have plagued the printing art. Specifically, it is within the contemplation of the present invention to provide new and improved methods for both printing and collating which individually and collectively lend themselves to a flexible and efficient method for printing diverse materials including both short and long run magazines, catalogs, booklets, brochures and the like. It is an object of the present invention to provide a printing method which lends itself to printing in one equipment and collation in another equipment with minimal handling of the printed material between such printing and collation while achieving excellent product quality.

It is a further object of the present invention to provide a printing process which involves minimal handling between the printing and collating phases of the process thereby realizing production economies by minimizing damage to work in process and reducing labor costs.

It is a further object of the present invention to provide both printing and collating methods which individually and collectively lend themselves to in-line automation in the production of printed products yet allow the substantially independent operation of the printing and collating phases of the printing process thereby avoiding too close an interdependence between such individual equipments.

It is a further object of the present invention to provide an improved printing and collating method in which, incident to the printing process, a provision is made for accurate orientation of the printed pages and which provision facilitates collation of such printed pages.

It is a further object of the present invention to provide a printing process which utilizes substantially narrower printing webs yet provides for the high speed multi-page production of printed material in a press configuration which essentially requires shorter set-up times with substantially reduced incidents of web breakage.

It is a further object of the present invention to provide an improved printing and collating method in which, incident to the printing process, a provision is made for accurate orientation of the printed pages and which provision facilitates collation of such printed pages.

It is a further object of the present invention to provide a printing process which lends itself to a press configuration which is readily adaptable to either one, two or four color printing, with minimal set-up times for switching into any one of such printing modes.

It is a further object of the present invention to provide a printing process in which printing is achieved on both sides of a web sequentially rather than simultaneously thereby reducing web breakage problems by avoiding the simultaneous wetting of both web surfaces required for simultaneous printing.

It is a further object of the present invention to provide a collating process which is integrated with a printing process, yet is independent from and which collating process is adaptable to collating varying groups of pages without the necessity of forming signatures and lends itself to an on-line process wherein collation can be followed by binding and trimming in the same equipment.

In accordance with method aspects of the present invention, there is provided a method of concurrently printing side-by-side groups of pages on a continuous or elongated web for subsequent collation and binding comprising the steps of printing first and second groups of pages on corresponding first and second side-by-side web sections. After the pages are printed side-by-side on the front and back of the web sections in the desired color or colors, each of the web sections are perforated along its length with a corresponding series of aligning holes. The series of aligning holes associated with each web section being oriented in relation to each other and to their respective printed pages for subsequent collation and binding of such printed web sections. Typically such series of aligning holes may be along one edge of each of the web sections and exclusive of the material comprising the finished printed product. The elongated web is then slit to separate the first and second web sections, with each web section containing one series of aligning holes, whereupon the separated first and second web sections are rewound, preferably on a common core, for subsequent collating and binding into the finished product.

The foregoing printing and processing operation can be practiced in a single piece of equipment which has built into it the capability of printing in one, two or four colors on each side of the web. The output of such equipment basically is a series of side-by-side rolls of printed pages with paired rolls being wound on a common core. Such side-by-side rolled pairs are the size and weight convenient for accumulation and storage and/or transfer to the collator phase of the printing process.

In accordance with embodiment demonstrating the collating method of the present invention, each preprinted pair of web sections wound in a side-by-side relation on a common core, are transferred to a multistation collator which provides the collated product. Specifically, the series of cores each having a pair of side-by-side web sections wound thereon are mounted in successive stations of the collator with each paired web section being oriented with respect to each other and to the other paired web sections for proper pagination of the final product. At each station of the collator two successive web sections containing pages of the printed collated product printed thereon are unwound from the side-by-side preprinted web sections with corresponding pairs of pages being brought into superposed relation to each other and in turn with successive superposed pairs of web sections from other stations likewise being brought into superposed relations to each other and to the remaining pages to be paginated. Such superposition and orientation of the preprinted rolled web sections is facilitated by the respective series of longitudinal holes formed in such web sections incident to the press operation. Upon orientation and collation of the paired web sections from the respective rolls in the successive stations of the machine, the stack of superposed web sections is advanced through the required stations to complete the collation of the product and directed to the finishing area where the product is stitched, cut, folded and trimmed.

In accordance with the process disclosed herein, after being collated the stack of superposed web sections are directed, on-line, to the finishing area where the stack is stitched or fastened and cut into individual groupings of pages roughly the size of the finished product. Next, the stitched groupings are folded about the stitch line and trimmed to form the completed product. In the trimming operation the edges of the already stitched, cut and folded products are trimmed removing the series of aligning holes so the final product made in accordance with this process has the appearance of a conventional magazine, booklet or similar printed matter.

The above brief description as well as further objects and features and advantages of the present invention will be more fully understood by reference to the following detailed description of a presently preferred nonetheless illustrative printing process in accordance with the present invention when taken in conjunction with the accompanying drawings, wherein.

It should be understood that although the following description may refer specifically to the printing of magazines or booklets this process is useful for printing of pamphlets, brochures and other types of printed material as well. Thus, the reference to magazines or booklets is merely intended to be illustrative and not restrictive. Further, although the process disclosed herein has been described with reference to particular embodiments, it is to be understood that those embodiments are merely illustrative of the principles and application of the invention.

Figure 1:
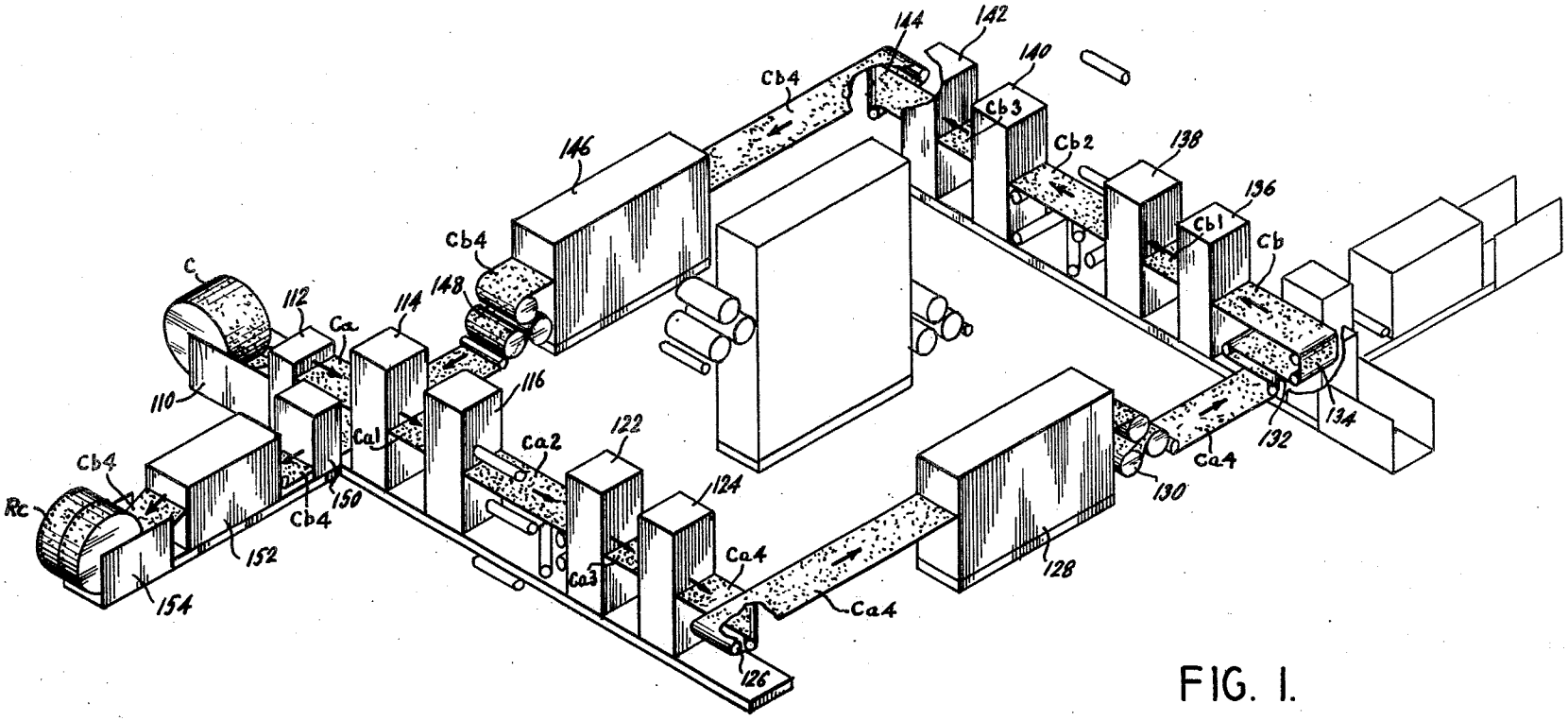
FIG. 1 is a diagrammatic drawing of the press configuration for two-sided, four colored printing and processing in accordance with the process disclosed herein (the unshaded equipment is not utilized)

In FIG. 1, there is shown a diagrammatic view of the process of two-sided, four-color printing as disclosed herein. For the sake of clarity, the web C in FIG. 1 is marked with additional symbols at various points in the process to indicate whether the first side or second side of the web is facing upwards and to further indicate the number of colors printed on that upward facing side. For example, Ca represents the first side of the web C facing upward and Cb the second. Ca1 indicates that the first side of the web C was facing upward and had been printed with the first color and so forth. A similar system of symbols is utilized on FIG. 2 to more clearly indicate the path of the respective webs A and B as described below. Specifically, a narrow, unprinted web of paper C is mounted in a conventional unwind stand 110 having an adjustable tensioning brake. Web C is threaded through a web aligning and automatic tensioning control tower 112 into first print tower 114 wherein the first side of the web, designated Ca, is printed on the first color. After passing through the first print tower 114, the web Ca, which contains the first color, (now designated Ca1) is directed into the second print tower 116 where the second color is printed. Next, the web Ca2 is fed through the third print tower 122 (Ca3) and finally through the fourth print tower 124 (Ca4) completing the four-color application of ink on the first side Ca of web C.

The web C then passes over turning rollers 126 making a right angle turn toward dryer 128 where the water and solvent used in the printing operation are removed from the one printed surface of the web by heat. Finally, the web C passes over chill rollers 130, completing the printing on the first side of the web.

Next, web C is directed through turning rollers 132 and reversing rollers 134 which place the already printed side Ca of the web C downward and orient the unprinted side Cb of the web C upwards. The web C passes through the fifth print tower 136 where web side Cb is imprinted with the first color on the second side. Similarly, the web C is passed through print towers 138, 140 and 142 wherein it receives the second, third and fourth printings on the second side, respectively. Web C, now designated Cb4, is again passed over the turning rollers 144, emerging at right angles to its former path. Web Cb4 is then directed through dryer 146, wherein the second side Cb is dried, and over chill rollers 148 completing the printing operation on the second side C6 of the web C.

As shown in FIG. 1, the printed web Cb4 emerges from the chill rollers 148, passing at right angles beneath the incoming web Ca between the web aligning and tension control tower 112 and the first print tower 114. After passing under the incoming web Ca, the printed web Cb4 enters the web control unit 150. Next, the web passes into the processing unit 152 wherein the web is punched with a continuous line of holes of approximately ⅛ inch diameter along one edge of the web Cb4 and a second line of holes along the opposite side of the central line of the web Cb4, over the entire length of the web. Next, the processing unit slits the web Cb4 along its center line forming two substantially symmetrical web halves or ribbons. Each ribbon is printed on both sides in the required number of colors and contains a continuous row of ⅛ inch diameter holes along one corresponding edge.

After being punched in the processing unit 152, the web is slit into two ribbons, the ribbons separated a small distance and wound in a roll Rc on a common core at the rewind stand 154. The printing and processing operation is thus completed.

Figure 2:
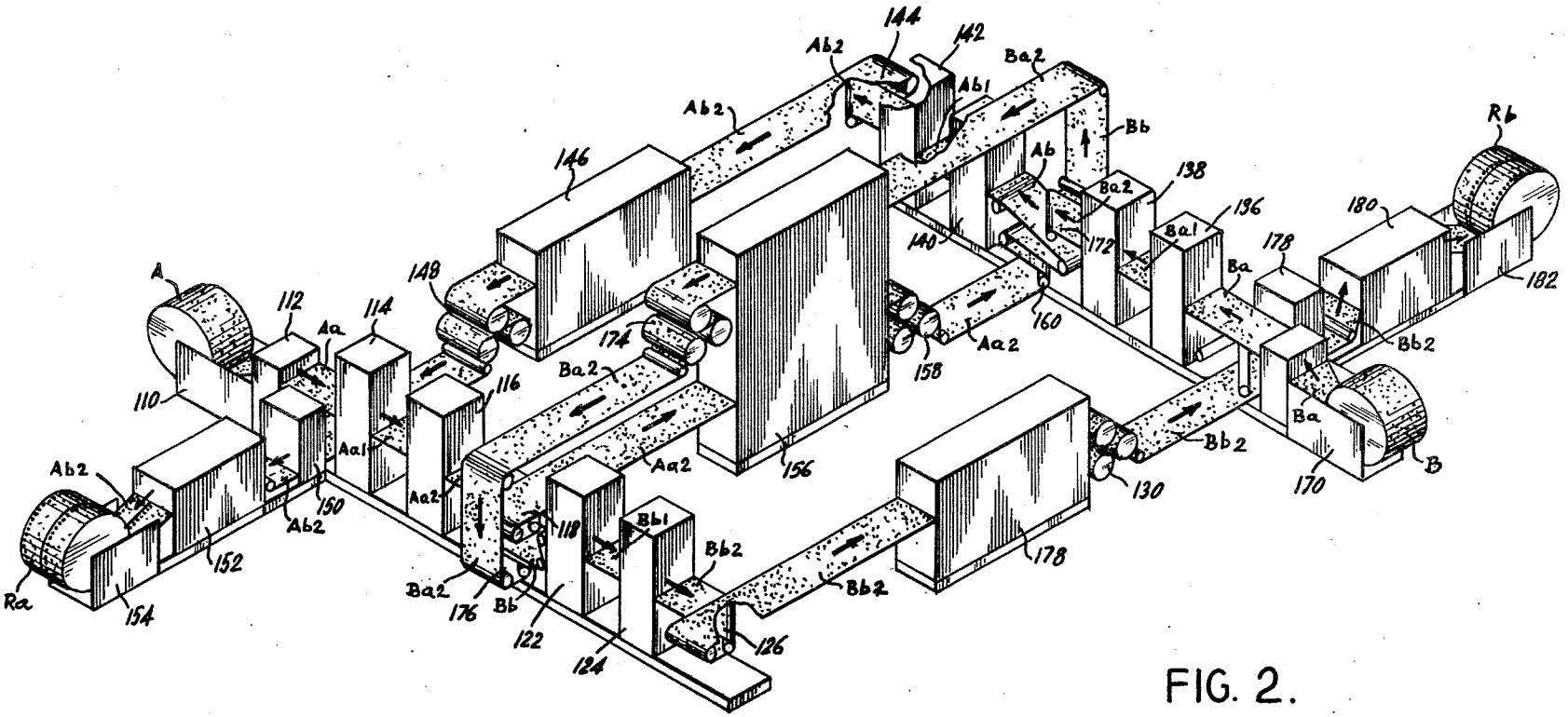
FIG. 2 is a diagrammatic drawing of the press configuration for two color, two-sided printing and processing wherein two webs are being printed and processed simultaneously.

Referring to FIG. 2, it can be seen that the apparatus of FIG. 1 can be utilized for the simultaneously printing of two webs, where each web is printed in two colors on each side of the web. To practice the process disclosed herein the first web designated A is printed on both sides Aa and Ab in print towers 114, 116 and 140, 142, respectively. The two sides Ba and Bb of web B are printed in print towers 136, 138, 118 and 124, respectively. Specifically, web A mounted in unwind stand 110 is directed through the web aligning and tensioning control tower 112 and into first print tower 114. Web Aa1 emerges from the first printing tower 114 and enters second print tower 116. At this point the path of web Aa2 diverges from the path of Ca2 shown in FIG. 1. Web Aa2 is directed over turning rollers 118 emerging at right angles to its original path into the bottom portion of dryer 156. After passing over chill rollers 158 the printing on the first side Aa2 of web A is completed. Web Aa2 then passes over turning and inverting rollers 160 emerging again at right angles to its prior path with the second side Ab of web A facing upward prior to entering print towers 140 and 142 wherein the second side Ab of web A is first printed in one color (Ab1) and then in a second color (Ab2). Finally, after emerging from print tower 142, web Ab2 is directed over turning rollers 162 and into dryer 146 where the second side of the web is dried and then passed over chill rollers 148. Web Ab2 then passes through the web control unit 150 and finally into the processor 152 where it is punched in the manner described above. After processing and slitting the two ribbons are wound into roll form Ra on a common core on the rewind unit 154.

Simultaneous with the printing of web A, web B is also printed on two sides with two colors of ink. Web B is fed from a conventional unwind stand 170 which is substantially the same as unwind stand 110. Web B is then directed through print tower 136 wherein one color is printed on the first side of web Ba (Ba1) and then through print tower 138 where the second color is printed on the first side (Ba2). Next, the web Ba2 passes over turning rollers 172 emerging at right angles to its original path, entering the upper portion of dryer 156. After this drying operation, the web Ba2 passes over chill rollers 174 and the printing on the first side Ba of web B is completed.

The printing of the second side Bb of web B is performed after the web B, with the first side Ba still facing upward, is directed over turning and inverting rollers 176 emerging at a right angle to its original path with the second, unprinted side Bb now facing upward. Web B then passes through print towers 122, 124 wherein the second side of web B is printed the two colors (after which the web is designated Bb1 and Bb2, respectively). Next web Bb2 passes over turning rollers 126, emerging at right angles into dryer 128 and over chill rollers 130 with the second side Bb2 still upward. Finally web B, now fully printed on both sides, is passed through the web control unit 178 and into the processor 180 (substantially the same as web control 150 and processor 152, respectively). After being punched in the processor 180 and slit in the same manner as web A, the two ribbons formed from web B are wound in roll Rb on the common core on rewind stand 182 (substantially the same as rewind stand 154).

Figure 3:
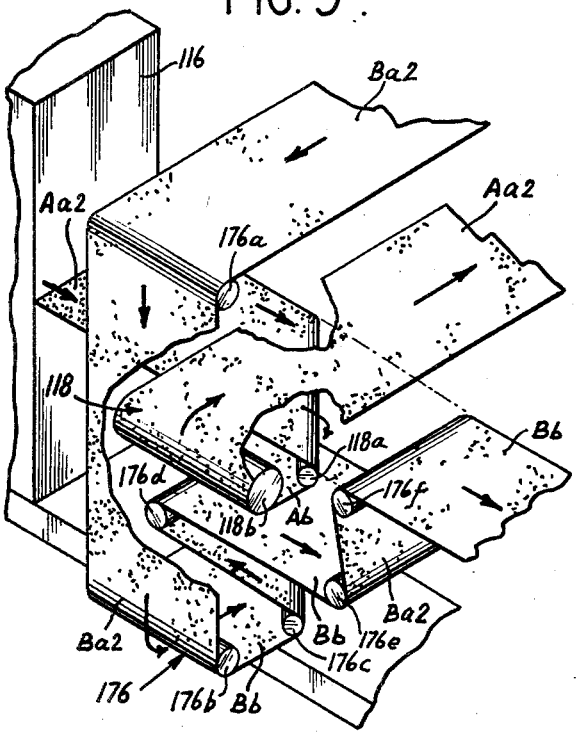
FIG. 3 is a detail of the turning rollers showing the right angle turn of one web and the turning and inverting of the other web.

FIG. 3 shows a detailed drawing of the turning rollers generally designated 118 used to cause web Aa2 to emerge at right angles to its original path after it passes out of print tower 116. As is evident from the notations in FIG. 3, the first side of web A is facing upwardly after being printed in two colors. Turning rollers 118 containing angled rollers **118*a*, 118*b* provide a means for shifting the path of web A while keeping the printed side Aa2 of web A upwards as it travels towards the bottom portion of dryer 156 (not shown in FIG. 3**).

FIG. 3 also shows the details of the turning and inverting rollers, generally designated 176, which cause web Ba2, which has just emerged from the top portion of dryer 156, to turn at right angles to its original path and to leave turning and inverting rollers 176 with the second, unprinted side Bb facing upwardly. Specifically, turning and inverting rollers 176 are comprised of first idler roller **176*a* which directs web Ba2 downwardly towards second idler roller 176*b*. Next, web Ba2 passes over angled roller 176*c* and inverting roller 176*d* after which the second, unprinted side Bb of web B is facing upward. Web Bb is then raised to the height of web Aa2 so it will be aligned with printing tower 122 (not shown in FIG. 3) by third and fourth idler rollers 176*e* and 176*f* respectively. After leaving rollers 176, web Bb is directed towards print tower 122** for the printing of the first color on the second side Bb, now facing upward.

The broken line in FIG. 3 shows the path taken by web C in the four-color printing process shown in FIG. 1 and described above. When this equipment is used for four-color printing web C is not directed around the turning or inverting rollers but passes straight through, from print tower 116 to print tower 122 (not shown in FIG. 3).

Figure 4:
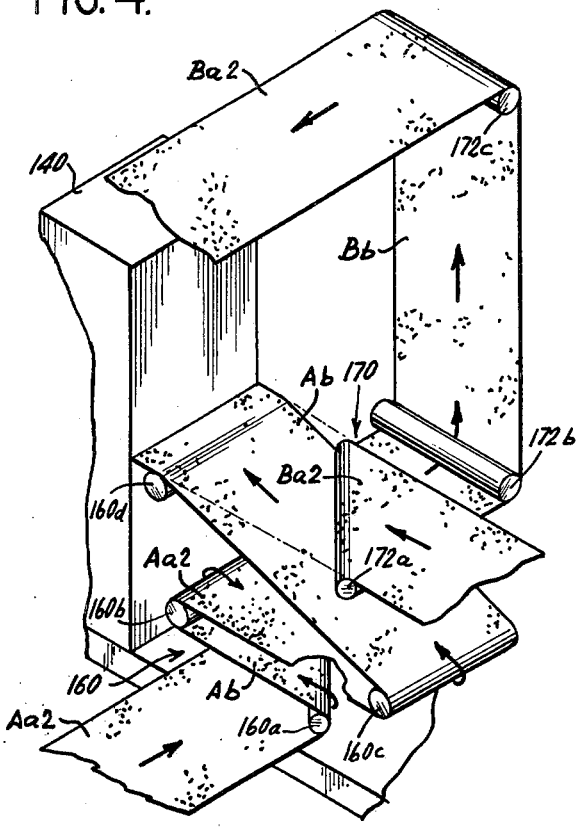
FIG. 4 is a detail of FIG. 2 showing the right angle turning and inverting of the first web and the turning of the second web.

FIG. 4 similarly shows the details of the turning rollers, generally designated 172, containing rollers **172*a*, 172*b* and idler roller 172*c* which cause web Ba2 to travel at right angles to its original path through print towers 136, 138 (not shown) and into the top portion of dryer 156 (not shown) after being printed with the second color Ba2 on its first side Ba. Similar in function to turning and inverting rollers 176 shown in FIG. 3 are turning and inverting rollers, generally designated 160, shown in FIG. 4. Rollers 160 include angled roller 160*a* and idler rollers 160*b*, 160*c* and 160*d* which cooperate to cause web Aa2 to change directions and emerge at right angles to its original path out of the dryer 156 (not shown) and to invert web Aa2 so that the unprinted side Ab is facing upward prior to entering print tower 140. In addition, idler rollers 160*c*, 160*d* raise the level of web Ab so it is aligned with printing tower 140** wherein it has the first color Ab1 printed upon its second side Ab.

Again, the broken line in FIG. 4 shows the path of web C in the four-color printing process. Web C passes directly from print tower 138 (not shown) to print tower 140 without having its path changed by the turning or inverting rollers shown in FIG. 4.

Figure 5:
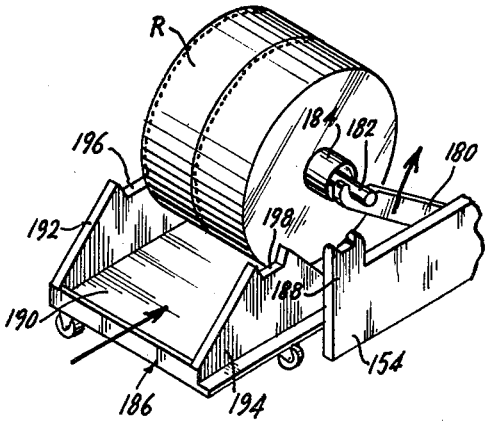
FIG. 5 shows a transport cart used for removal or storage of the printed web and core from the printing apparatus.

FIG. 5 shows removal of the two, printed, punched and slit ribbons designated R and wound on a common core 184 from the conventional rewind stand 154 (or 170). Arms 180 (only one is shown) are actuated hydraulically to lift ribbons R by the core 184 through which a shaft 182 has been passed. A specially structured cart 186 is placed between the upstanding walls 188 of rewind stand 154. The cart 186 has a bottom portion 190 and upright wall portions 192, 194 adapted to pass beneath the printed ribbons R with the upright wall portions 192, 194 adjacent the ends of the ribbons R and receiving journals 196, 198 on each upright wall 192, 194, respectively. The receiving journals 196, 198 are specifically adapted to engage the end portions of core 184. Hydraulically actuated arms 180 lift the roll R to a sufficient height to allow cart 186 to be placed directly beneath roll R in such manner that receiving journals 196, 198 of cart 186 support the core 184 when arms 180 are lowered allowing said roll R to rotate about core 184 within cart 186.

Figure 6:
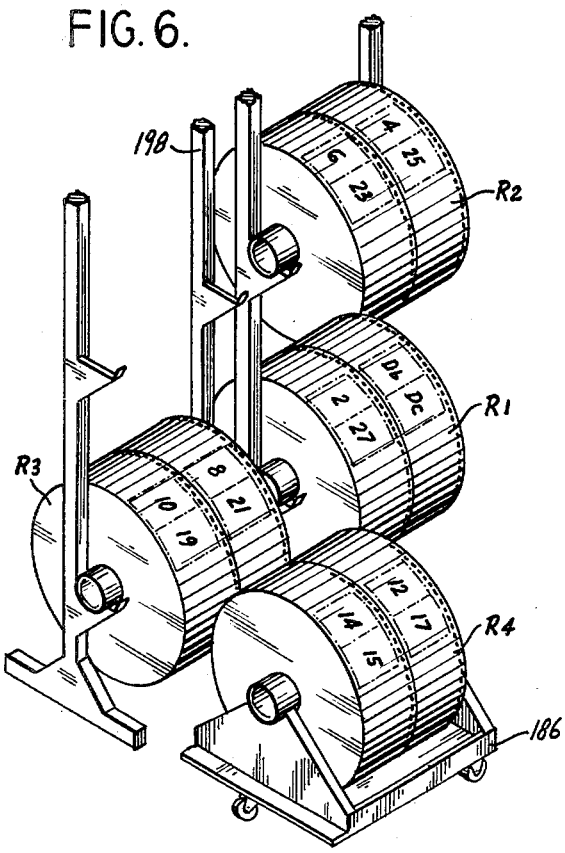
FIG. 6 is a perspective view of the racks used for storage of the printed webs.

As shown in FIG. 6, once cart 186 is loaded with the printed rolls R, such rolls R may be kept in cart 186 for storage purposes or removed from cart 186 and placed in storage racks 198 in a convenient location. In accordance with the method disclosed herein, the entire magazine or booklet is first printed onto the necessary number of webs which are then fully processed into punched ribbons, rewound on cores and stored until all pages of the magazine or booklet are printed.

When the printing operation is completed all the printed rolls R necessary to form the entire magazine or booklet are removed from storage in racks 198 and placed in carts 186 to be collated. Those ribbons R that were stored in carts 186 are merely moved from their storage locations to the collating area.

Figures 7, 8:
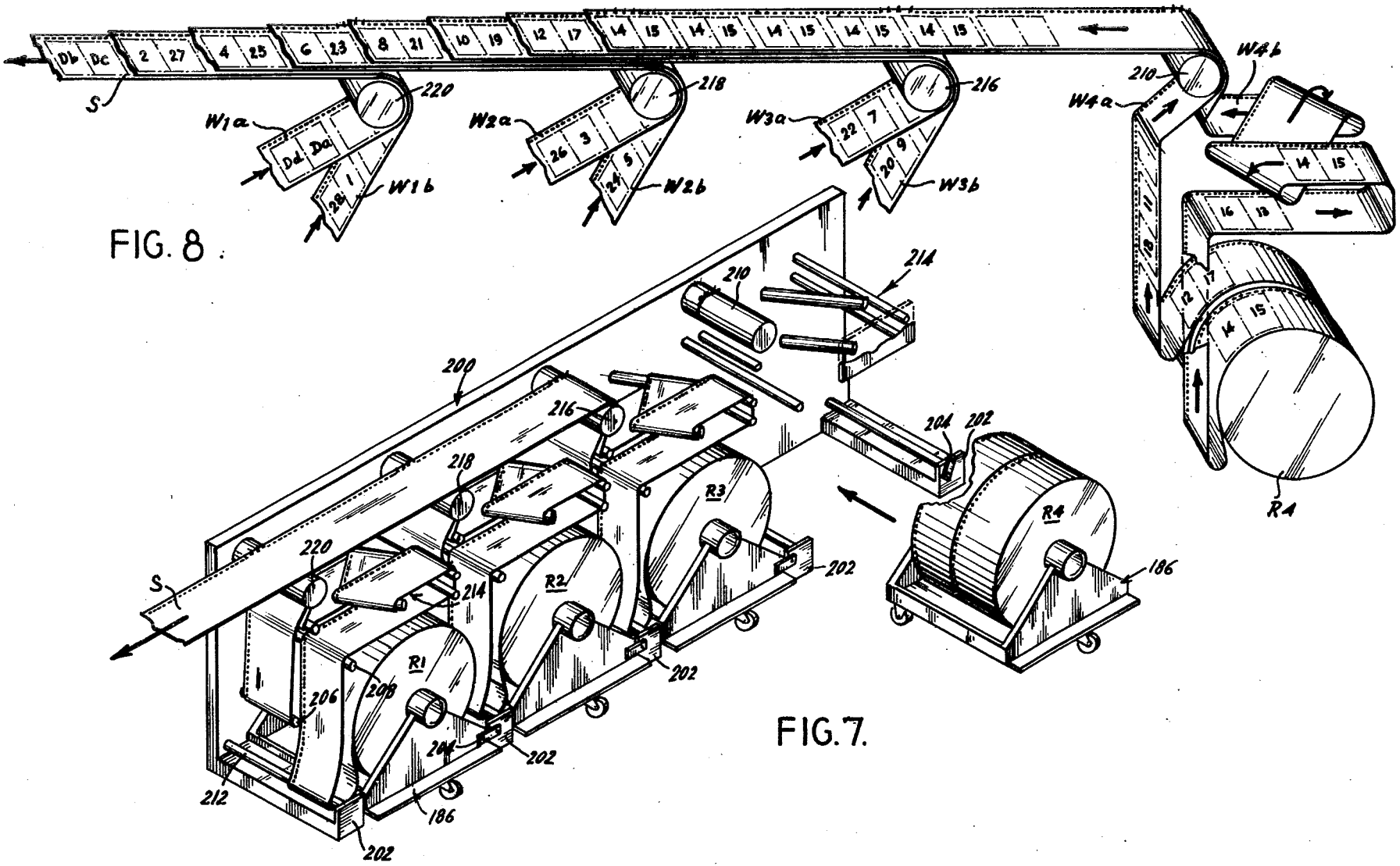
FIG. 7 is a perspective view of the collator apparatus used to practice the process disclosed herein showing the multiple work stations of the collator.
FIG. 8 is a diagrammatic view of the collation process.

The collation operation is performed by the collator, generally designated by reference numeral 200. Each pair of printed ribbons, designated R1, R2, R3 and R4 in FIG. 7 for the sake of clarity, loaded in carts 186 are placed in proper sequence and engaged in collator 200. As shown in FIG. 7, bottom rails 202 of collator 200 are so spaced as to allow carts 186 to be slidingly engaged in the respective work stations of collator 200. Carts 186 are held in place by locking levers 204.

As shown diagrammatically in FIG. 8 using roll R4 as an example, the innermost ribbon designated by the symbol W4*a* is directed around an idler roller 206 (shown in FIG. 7), upwardly over a dual idler roller 208 and finally around a pinroller 210 after which it follows a substantially horizontal path towards the adjacent, down-line work station. Ribbon W4*b* is similarly fed downwardly over an idler roller 212, upwardly over the dual idler roller 208 and then horizontally to a series of translating rollers generally designated 214. The translating rollers 214 redirect the outer ribbon W4*b* into coextensive relation with the inner ribbon W4*a*. Outer ribbon W4*b* is then fed on top of inner ribbon W4*b* over pinroller 210. A plurality of extending pins in pinroller 210 engage the punched holes in each ribbon W4*a*, W4*b*, aligning the ribbons and the printed pages on each pair of ribbons in precise, superposed, collated relationship with regard to each other.

The collation operation described above for roll R4 is substantially duplicated for each roll R1, R2 and R3 at the respective work stations of the collator 200. Specifically, the coextensive ribbons W3*a* and W3*b* of roll R3 are fed over pinroller 216 at the adjacent, down-line work station to the work station containing roll R4. At pinroller 216 the superposed, collated ribbons W4*a*, W4*b* meet the superposed collated ribbons W3*a* and W3*b* forming a superposed, collated stack of four ribbons. Similarly, ribbons W2*a* and W2*b* are fed over pinroller 218 at the next adjacent, down-line work station wherein the superposed, collated grouping of ribbons is increased to a thickness of six. Finally, the cover and additional pages printed on roll R1 are added at the first work station shown in FIG. 7. Pinroller 220 now moves the complete stack of superposed collated ribbons, eight ribbons thick, designated by the reference letter S, to the next operation for final finishing of the magazine or booklet.

As shown in FIG. 8, roll R4 contains ribbon W4*a* having printed thereon pages 11, 18 on one side and 12 and 17 on the other and ribbon W4*b* with pages 14, 15 on one side and pages 13 and 16 on the other. In the printing operation of roll R4, each plate cylinder contains the image of pages 12, 17, 14, and 15 in the configuration shown on roll R4 in FIG. 6. In the offset printing process, the image on the plate cylinder is transferred to a blanket roller of diameter precisely twice that of the plate cylinder. Consequently, the plate cylinder will transfer two full images of the four pages being printed to the blanket roller which then prints two full images of the four pages incident to one complete rotation of the blanket cylinder. Thus, for each rotation of the blanket cylinder, two of the complete patterns shown on roll R4 in FIG. 6 are printed.

In the collating operation, the outer ribbon such as W4*b* which is directed over the translating rollers 214 and the various idler rollers, necessarily travels on a longer path than the corresponding inner ribbon W4*a*. Consequently, when W4*b* comes into coextensive relationship W4*a* on pin roller 210 it is necessary to collate pages 11, 18, 12 and 17 with a later printed set of pages 14, 15, 13 and 16. Thus, the first image of ribbon W4*a* is collated with the first image of the second impression (the third impression, overall) of ribbon W4*b*.

The punching of holes along the sides of each ribbon in the processing units 152, 180 is similar to printing an additional color in that the holes are punched in precise registration with the color printing on the web to provide a constant correlating means for the subsequent collation of the ribbons. Thus, the pins of pinroller 210 enable the collator to precisely orient the four printed pages on each of the two ribbons W4*a*, W4*b* on the set of ribbons R4 with regard to each other. Similarly, the pinrollers and precisely located punched holes on the other ribbons assure that the pages printed on each web are collated precisely with the corresponding pages on the next set of ribbons.

Roll R1 as shown in FIG. 8 contains ribbon W1*a* and ribbon W1*b*. W1*a* comprises the four pages of the cover designated Da, Db, Dc and Dd. Ribbon W1*b* contains pages 1, 2, 27 and 28. Both the cover and adjacent pages can be printed on roll R1 when the cover material is made of the same paper stock as the internal pages. In those circumstances where the cover is to be made of heavier or otherwise different stock than the interior pages, roll R1 will contain only the cover pages shown on ribbon W1*a* in FIG. B and not pages 1, 2, 27 and 28. The pages corresponding to pages 1, 2, 27 and 28 would then be printed on the ribbon W2*a*. Necessarily, the page numbers would differ since the magazine or booklet collated from four rolls wherein roll R1 contains only the four cover pages and the magazine or booklet would contain only twenty-four internal pages and four cover pages for a total of twenty-eight pages rather than the total of thirty-two pages (including cover) as shown in FIG. 8.

If additional pages are needed for the magazine or booklet, it is possible to add stations to the collator shown in FIG. 7. Each station would add an additional eight pages to the completed magazine or booklet. At some point, it is impractical to add additional stages to the collator as the stack of ribbons becomes too thick to be reliably moved by the down-line pin rollers. If the pins are made longer to accommodate the thicker stack of ribbons the longer pins may tend to tear the punched holes as the pin rollers rotate causing the stack to lose its precise assignment. At present, approximately six stations are the optimum number of stations for a collator of a configuration shown in FIG. 7 although it is possible to run in excess of twelve stations.

If additional pages are needed for a magazine, it is possible to use two collator assemblies and to feed the superposed, collated completed ribbons S and S′ together after the last pin-roller of each collator. The combined stacks S and S′ would be superposed prior to the stitching, cutting, folding and finishing operation described below.

A second alternative for collating larger magazines would involve completing the below described stitching, cutting, folding and trimming operation on small signatures and then binding the required number of finished signatures into a conventional backbound configuration in another operation.

Figures 9, 10, 11:
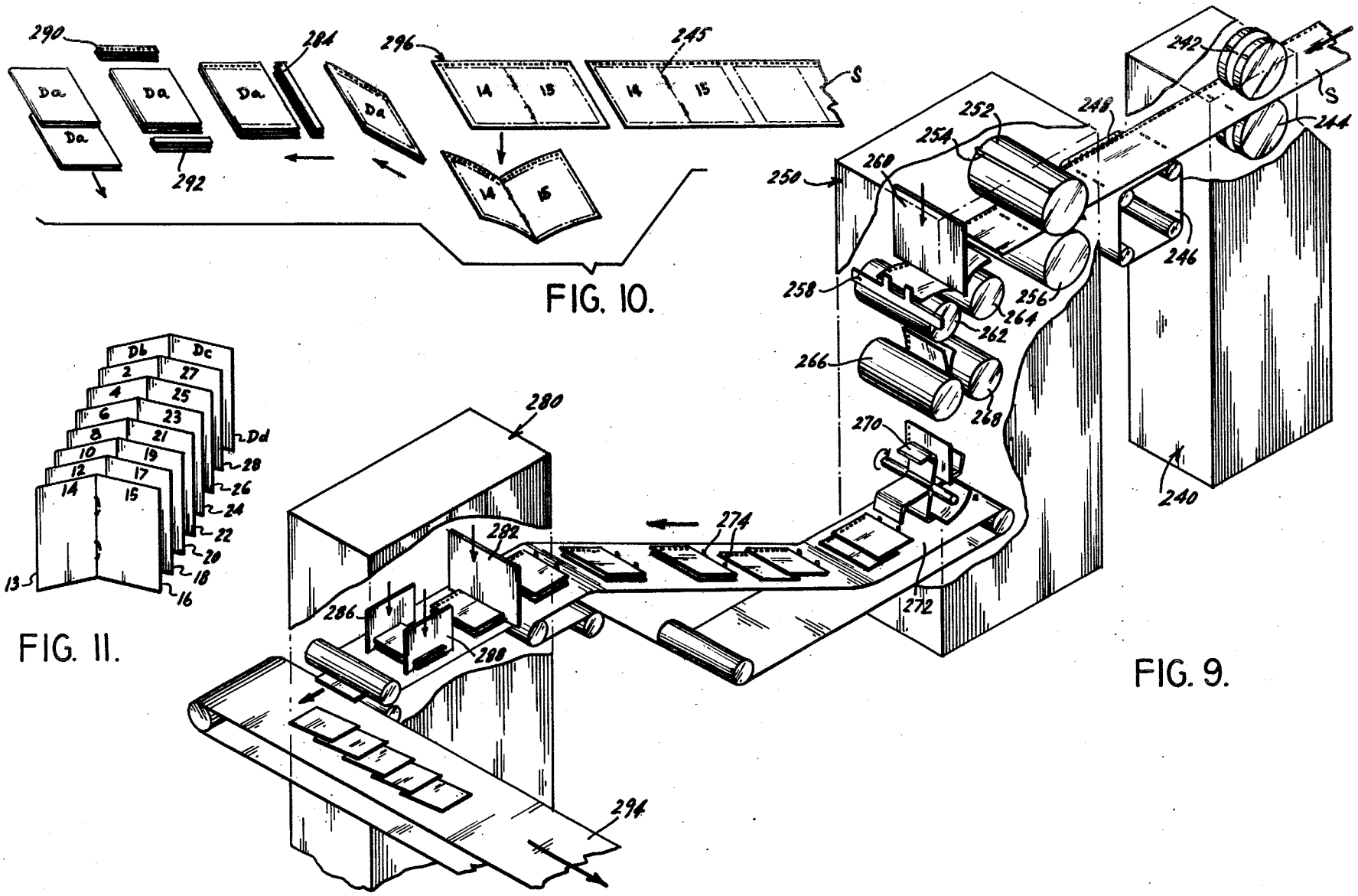
FIG. 9 is a diagrammatic view of the finishing process wherein the collated stack of printed ribbons is stitched, cut, folded and trimmed.
FIG. 10 is a pictorial view of the stitching, cutting, folding and trimming process.
FIG. 11 is an exploded view of the magazine showing the arrangement of the pages and cover in proper sequence.

The final finishing operation of the process disclosed herein is shown in FIG. 9. The complete, superposed, collated stack of ribbons S is stitched, cut, folded and trimmed to form the completed magazine in a fully automated operation, downline from the collator 200. The stack of ribbons S travels from the collator 200 to a stitching machine generally designated by reference numberal 240. In the stitching machine 240, the stack of ribbons S is directed between stitching rollers 242, 244 where a staple or similar fastening device is placed along the stitchline 245, the centerline between the lefthand and righthand pages in each two-page long image. The stitching operation is repeated along the length of the stack of ribbons S.

After being stitched, the still uncut stack of ribbons S passes out of the stitching machine 240 over a caterpillar roller 246 having a plurality of pins 248 along one edge adapted to engage the same holes at the edge of stack S used for collating the individual ribbons. The caterpillar roller 246 causes the stack S to enter the cutting and folding apparatus generally designated by reference numeral 250. As shown in FIG. 9, the cutting roller 252 contains two sets of cutting blades 254 and is of such diameter that every half rotation will cause one set of cutting blades 254 to cut the stitched stack S between each complete set of stitched pages to form the untrimmed magazine or booklet. Backing cylinder 256 cooperates with cutting roller 252 to both propel stack S into the cutting and folding machine 250 and to provide a hard surface to cooperate with the cutting blades 254 to cut through the stack S.

After being rough cut, each booklet then passes into the folding area of cutting and folding machine 250. Next, the rough cut booklets are moved horizontally until the leading edge of the booklet reaches stop 258. At such a point, stuffer bar 260 moves vertically downward causing the booklet to be folded along the stitchline 245 by nip rollers 262, 264. Next, final folding is achieved by passing the partially folded booklet through folding rollers 266, 268 which cooperate to form a tight fold in the booklet about stitchline 245.

After being folded, the still untrimmed booklets leave folding rollers 266, 268 and are placed on a multi-armed, separating roller 270. Roller 270 places the booklets on a continuous conveyor belt having multiple pairs of upstanding projections 274 separating belt 272 into individual areas. Roller 270 places two untrimmed booklets in each individual area adjacent the upstanding projections 274. Roller 272 then transports the booklets up a slight incline causing each pair of booklets to slide backward along the belt 272 until the unfolded trailing edge of each booklet is resting against upstanding projections 274. At the top of the incline, the conveyor belt 272 causes each stack of two untrimmed booklets to enter the final trimming unit generally designated 280, wherein trimming blade 282 shears off the untrimmed excess 284 (shown in FIG. 10) from the outer unfolded edge of the book or magazine. Next, top and bottom trimming blades 286, 288 respectively, remove the excess portions 290, 292 from the top and bottom of the book or magazine. Top portion 290 contains the roll of punched holes so that when portions 290 and 292 are removed from the book or magazine, a complete, finished magazine results. Finally, these completed magazines are placed on another conveyor belt 294 for delivery to the shipping area.

FIG. 10 is a diagrammatic representation of the process occurring in the stitching unit 240, the cutting and folding machine 250 and the final trimming unit 280. In a 28 page booklet or magazine with a four page cover the top ribbon of stack S contains multiple images of pages 14 and 15 as shown in FIG. 10. The cutting blades 254 cut the stack S into separate groupings 296, each grouping containing a complete set of printed pages. The stitchline 245 of each grouping 296 divides the front cover and pages 1 through 14 on the left side from pages 15 through 28 and the back cover on the right side. After the already stitched ribbon is cut into the individual groupings 296 each grouping is folded precisely along the stitchline 245. After being folded, the booklet enters the final trimmer with the folded portion first. Punched holes and the remaining excess portions of the booklet are removed and the completed magazine is ready for use.

To clarify the pagination resulting from the process described herein, FIG. 11 shows an exploded view of the magazine indicating the proper sequence of the cover and pages.

By practicing the process disclosed herein it is possible to substantially reduce the amount of unproductive time for the equipment by substantially shortening the set up time required. This process is keyed to the use of webs that are only two ribbons wide instead of eight ribbons wide. The use of narrower webs contributes to this savings since there is less likelihood of web breakage. In addition, it is possible to use the printing presses while the collating equipment is being set up. Further, downtime of the press does not effect the operation of the collator, and downtime of the collator similarly has no effect on the running of the press.

By handling the printed material in roll form rather than in the form of printed and folded signatures there is less likelihood of damage to that printed material. The signatures are never handled manually and thus a more precise and cost efficient amount of material need only be printed rather than a substantial overrun to assure that there will be enough undamaged material for binding.

The general configuration of the apparatus used in practicing the process disclosed herein is substantially rectangular. This configuration is significant in two aspects. This configuration is compact and space efficient, locating the finished, printed material on the rewind stand 154 in an area close to the unwind stand 110 so the equipment used for handling the web rolls can be kept in the same part of the factory.

Of even greater significance is the fact that the rectangular configuration of the equipment disclosed herein makes it possible to maintain precise registry between the printing of the four colors on a single side of the web C. The precise registry is a direct result of the short distance between adjacent print towers. This spacing is maintained even though the equipment is adaptable to two-sided printing using the same print towers, which requires the introduction of a dryer between the first two print towers used to print the first side of the web and the second two print towers used to print the second side of the web.

The process disclosed herein where one side of the web is printed and dryed prior to the printing on the other side, reduces the likelihood of breakage of the web because only one side of the web is wet at any given time. As discussed above, this procedure is in contrast to the conventional methods of printing wherein both sides of the page are printed simultaneously.

Although the process disclosed herein has been described with references to particular embodiments, it is to be understood that these embodiments are merely illustrative of the principles and application of the invention. For example, a wide range of stitching, folding and finishing apparatus is available which could be utilized to complete the magazine. Thus, it is to be understood that numerous modifications may be made in the illustrative embodiments and the example of the invention and other arrangements may be devised without parting from the spirit and scope of this invention.

What is claimed is:

1. A method for collating printed material on a web having printed longitudinal inner and outer web sections wound as a web roll on a common core with each of said web sections having a series of aligning holes along an edge thereof comprising the steps of loading a plurality of said roll wound webs in said collator in proper relative orientation with respect to said preprinting, unwinding each of said roll wound webs by utilizing said series of aligning holes, separating said web sections, then moving said separated inner and outer web sections into superposed relationship with one another, moving said plurality of webs into superposed collated orientation utilizing said series of aligning holes forming a superposed stack of collated web sections.

2. A method of concurrently printing side-by-side groups of pages on an elongated web having first and second surfaces for subsequent collation and final finishing comprising printing first and second groups of pages on corresponding first and second longitudinally extending side-by-side web sections on the first surface of said elongated web in at least a first color, perforating said elongated web along its length with corresponding first and second series of aligning holes along edges of said corresponding first and second web sections with said aligning holes being oriented in relation to each other and to the respective groups of printed pages in registration with said first and second groups of pages, slitting said elongated web to separate said first and second web sections for subsequent collation and final finishing, rewinding said separated first and second web sections on a common core for subsequent collation and final finishing utilizing said first and second series of aligning holes for moving said separated first and second web sections into superposed relationship to one another.

3. The method of claim 1 further including the step of printing said first and second groups of pages on said first surface of said web sections in at least one additional color which is in registration with said first color.

4. The method of claim 1 further including the step of drying said first surface of said elongated web after printing said first and second groups of pages on said elongated web.

5. The method of claim 4 further including the step of printing corresponding third and fourth groups of pages on the second surface of said elongated web on the second surface of said corresponding first and second side-by-side web sections in at least a first color after drying said first surface of said elongated web, said third and fourth groups of pages oriented in relation to said first and second groups of pages.

6. The method of claim 5 further including the step of printing said third and fourth groups of pages on said web section in at least one additional color which is in registration with said first color printed on said second surface of said web sections.

7. The method of claim 5 further including the step of drying said second surface of said elongated web after printing said third and fourth groups of pages on said elongated web.

8. A method of collating pre-printed longitudinal web sections having lines of pre-punched holes in each web section along an edge of said web section extending the length thereof wound in side-by-side relation on a common core in a multi-station collator to provide a collated product comprising the steps of loading each core containing a pair of side-by-side web sections into a station in said collator in proper orientation with regard to pagination, unwinding the side-by-side web sections at each of said stations, directing one web section of two side-by-side web sections into superposed relation to the second web section in said pair utilizing the corresponding lines of pre-punched holes in each of said web sections adjacent said edge thereof to achieve such orientation, superposing successive pairs of superposed web sections with further paired superposed web sections from other stations of said collator utilizing said lines of pre-punched holes for orienting said successive pairs, engaging the superposed lines of pre-punched holes in the superposed pairs of web sections to advance the same through said multi-station collator and while so advancing the same, performing work operations thereon.

9. The method of printing and collating printed products comprising the steps of printing groups of pages on corresponding first and second side-by-side web sections of an elongated web, perforating each of said web sections along its length with a series of aligning holes, subsequently slitting said elongated web into the respective first and second web sections, rewinding said separated first and second web sections on a common core, moving said first and second web section into superposed relationship with one another utilizing said series of aligning holes to form a superposed pair of web sections, combining said superposed pair of web sections with successive superposed pairs of web sections utilizing said series of aligning holes to form a superposed stack of collated web sections.

10. The method of claim 9 further including the steps of fastening said superposed stack of collated web sections at a stitchline located relative to said groups of pages printed on said web sections, cutting said stitched web sections to form individual assemblies of fastened groups of pages, folding said assemblies about said stitchlines, removing said series of aligning holes, and trimming said printed product.

11. The method of printing and collating printed products comprising the steps of printing groups of pages on corresponding first and second side-by-side web sections of an elongated web, perforating each of said web sections along its length with a series of aligning holes, rewinding said elongaged web on a core, slitting said perforated elongated web into the respective first and second web sections, redirecting at least one of said first and second web sections by passing said at least one of said first and second web sections over a roller to orient said first and second web sections into superposed relationship utilizing said series of aligning holes to form a superposed pair of web sections, combining said superposed pair of web sections with successive superposed pairs of web sections utilizing said series of aligning holes to form a superposed stack of collated web section.

* * * * *